US005617637A

United States Patent [19]

Pai

[11] Patent Number: 5,617,637

[45] Date of Patent: Apr. 8, 1997

[54] CUTTING TOOL FOR CUTTING SLICES OF A PREDETERMINED THICKNESS

[76] Inventor: Chung-Jeng Pai, No. 10, Lane 423, Ching Shin Street, Chung Ho, Taipei Hsien, Taiwan

[21] Appl. No.: 630,573

[22] Filed: Apr. 10, 1996

[51] Int. Cl.[6] ..... B26B 29/02

[52] U.S. Cl. ..... 30/283; 30/293

[58] Field of Search ..... 30/282, 283, 284, 30/293, 289

[56] References Cited

U.S. PATENT DOCUMENTS

| | | | |
|---|---|---|---|
| 2,856,688 | 10/1958 | Kopel | 30/283 |
| 2,938,269 | 5/1960 | Nissen | 30/283 |
| 3,191,301 | 6/1965 | Rubinstein | 30/283 |
| 3,222,784 | 12/1965 | Phillips et al. | 30/283 |
| 3,262,203 | 7/1966 | Hahn | 30/283 |
| 3,271,855 | 9/1966 | Stolbach | 30/283 |
| 3,981,078 | 9/1976 | Alberti | 30/293 |

FOREIGN PATENT DOCUMENTS

| | | | |
|---|---|---|---|
| 919669 | 2/1963 | United Kingdom | 30/283 |

*Primary Examiner*—Hwei-Siu Payer
*Attorney, Agent, or Firm*—Bacon & Thomas

[57] ABSTRACT

A cutting tool capable of cutting slices of a predetermined thickness. The cutting tool includes an elongate handle, a sheet-like blade connected to the handle and having a sharpened lower cutting edge, an L-shaped support piece connected onto the blade adjacent to the handle, the support piece having a part thereof perpendicular to the blade and provided with an internally threaded hole, a press piece consisting of a press seat, a horizontal upper portion and a vertical portion perpendicular to the upper portion, the press seat being dimensioned to match the part of the support piece with the hole and having an elongate slot, the vertical portion having a width slightly greater than that of the blade, and a rotary knob having a cap and a shaft projecting from a bottom thereof, the shaft having outer threads for matching the hole of the support piece so that the shaft may be passed through the slot of the press seat and locked in the hole of the support piece.

8 Claims, 3 Drawing Sheets

CUTTING TOOL FOR CUTTING SLICES OF A PREDETERMINED THICKNESS

BACKGROUND OF THE INVENTION (a) Field of the Invention

The present invention relates generally to a cutting tool, and more particularly to a cutting tool for cutting food into slices of a predetermined thickness.

(b) Description of the Prior Art

Cutting loaves of bread, sausages, fish, fruit and the like into slices of uniform thickness may not be difficult to chefs. But it may pose a problem for ordinary housewives.

SUMMARY OF THE INVENTION

Accordingly, a primary object of the present invention is to provide a cutting tool for cutting slices of a desired thickness.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
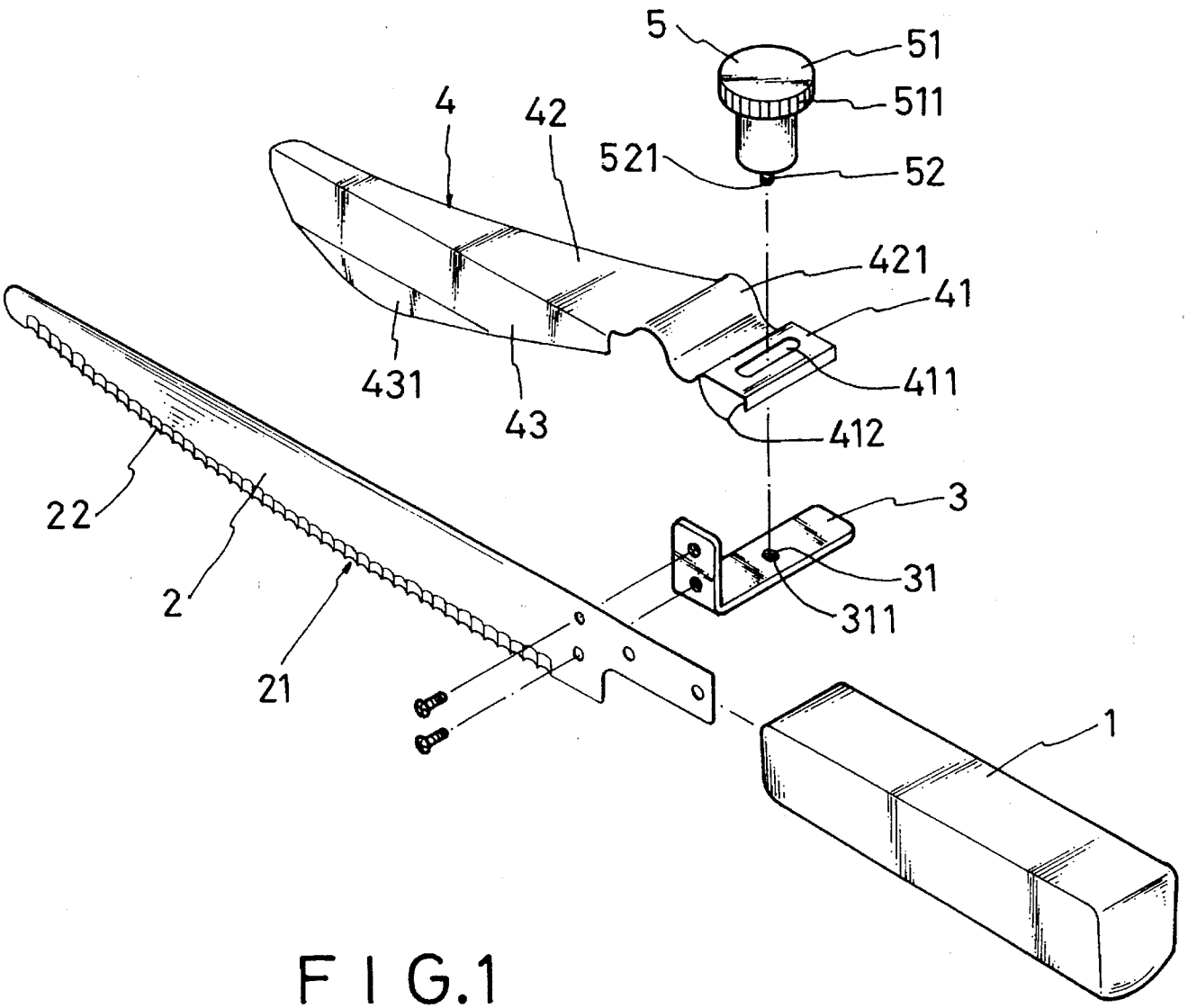
FIG. 1 is an exploded perspective view of the cutting tool of the present invention.

With reference to the drawings, the cutting tool according to the present invention essentially comprises a handle 1, a blade 2, a support piece 3, a press piece 4, and a rotary knob 5.

The handle 1 is an elongate structure for connecting the blade 2. In order that the cutting tool of the invention may be operated manually or electrically, an insert means 11 may be correspondingly provided on the handle 1.

The blade 2 is a sheet-like structure connected to the handle 1. In a preferred embodiment of the present invention, it is enveloped by the handle 1. At a lower end of the blade 2 is a cutting edge 21 having a pointed cross-section. The cutting edge 21 may also be configured to have corrugations 22 so as to enhance its sharpness.

The support piece 3 is an L-shaped plate-like structure connected to the blade 2 adjacent to the handle 1. In the preferred embodiment of the present invention, it is locked to the blade 2 by means of screws. But it may also be connected thereto in another manner, such as by means of rivets or welding. In order that the support piece 3 may be connected to the press piece 4, that part of the support piece 3 which is perpendicular to the blade 2 is provided with a hole 31 having multiple inner threads 311.

The press plate 4 consists of a press seat 41, a horizontal upper portion 42 and a vertical portion 43 perpendicular thereto. In the preferred embodiment of the present invention, the press piece 4 is integrally punched from a metal sheet. However, it may also be made from other materials and in other ways. For instance, it may be integrally injection molded from high molecule polymers. The press seat 41 is dimensioned to match that part of the support piece 3 with the hole 31 and is provided with an elongate slot 411 at a central portion thereof. In order that the press seat 41 may be firmly connected to the support piece 3, both ends thereof may be integrally curved to form curves 412 for retaining the support piece 3 below. And in order that the upper portion 42 may have better resilience when pressing downwardly, the end of the upper portion 42 adjacent to the press seat 41 is configured to have at least one wavy curve 421. The width of the vertical portion 43 is greater than that of the blade 2, and the lower edge thereof, i.e., the lowermost edge, may be bent outwardly to form a flange 431 for purposes of slightly increasing the distance.

The rotary knob 5 has a cap 51 circumferentially provided with spared ribs 511, a shaft 52 projecting from a bottom thereof, the shaft 52 being dimensioned to match the hole 311 of the support piece 3 and having multiple outer threads 521.

Figure 2:
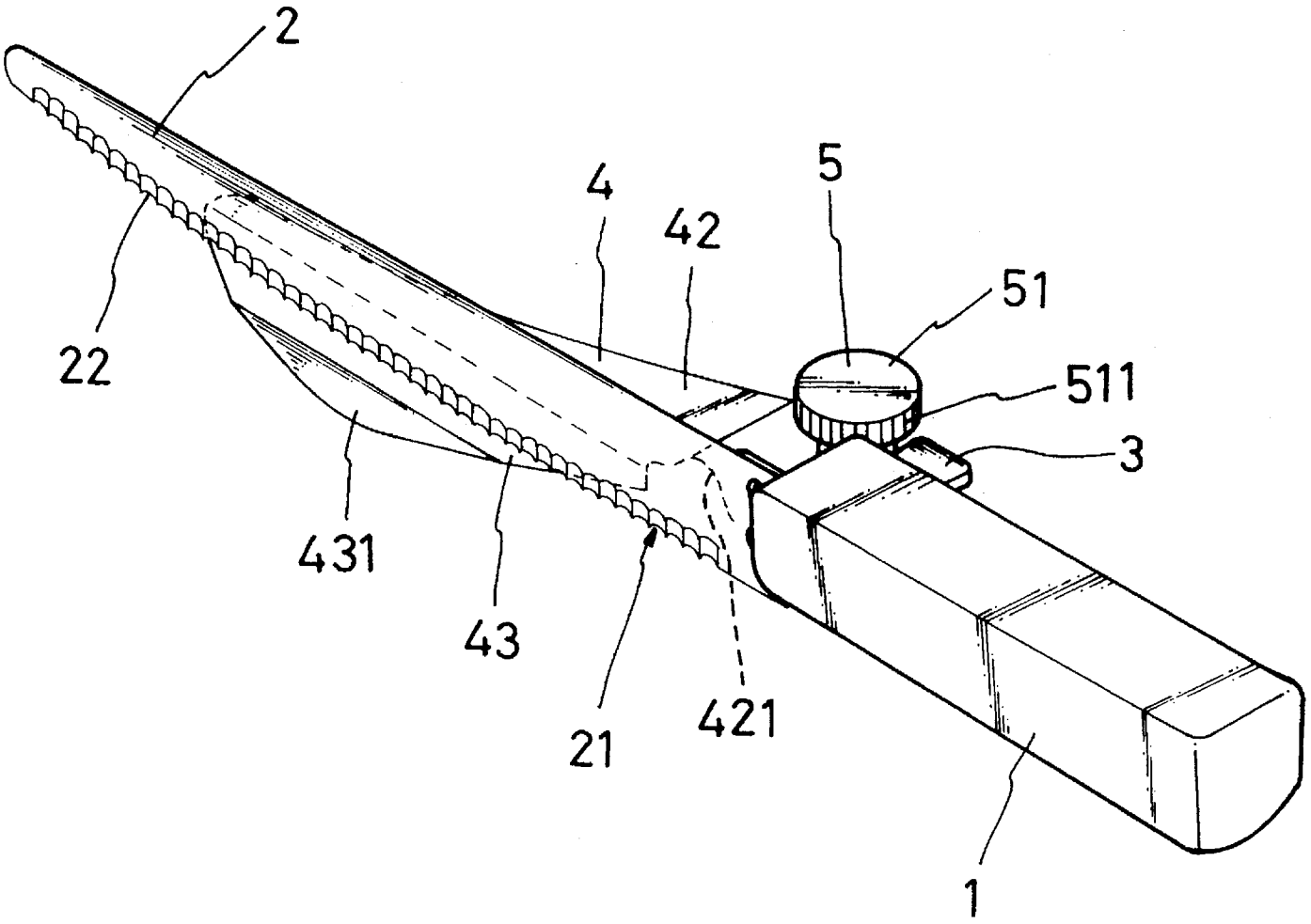
FIG. 2 is a perspective view of the assembled cutting tool of the present invention.

With reference to FIG. 2, in assembly, the blade 2 is connected to the handle 1 while the support piece 3 is connected to the blade 2 adjacent to the handle 1. The press piece 4 is then fitted onto the support piece 3 with the press seat 41 arranged on that part of the support piece 3 with the hole 31. The shaft 52 of the rotary knob 5 is then passed through the slot 411 and threads 52 are engaged with the threads 311 of the hole 31 of the support piece 3.

When the cutting tool of the present invention is used to cut sausages or loaves of bread, the vertical portion 43 of the press piece 4 may be arranged to lie close against the outer side of the sausage or bread before cutting. In this way, since the distance between the press piece 4 and the blade 2 is fixed, all the slices of sausage or bread are uniform in thickness.

If it is desired to adjust the thickness of the slices, the rotary knob 5 may be loosened so that the press piece 4 can slidably displace horizontally. After adjustment is done, the shaft 52 of the rotary knob 51 is passed through the slot 411 and threadedly engaged in the hole 31.

Figure 3:
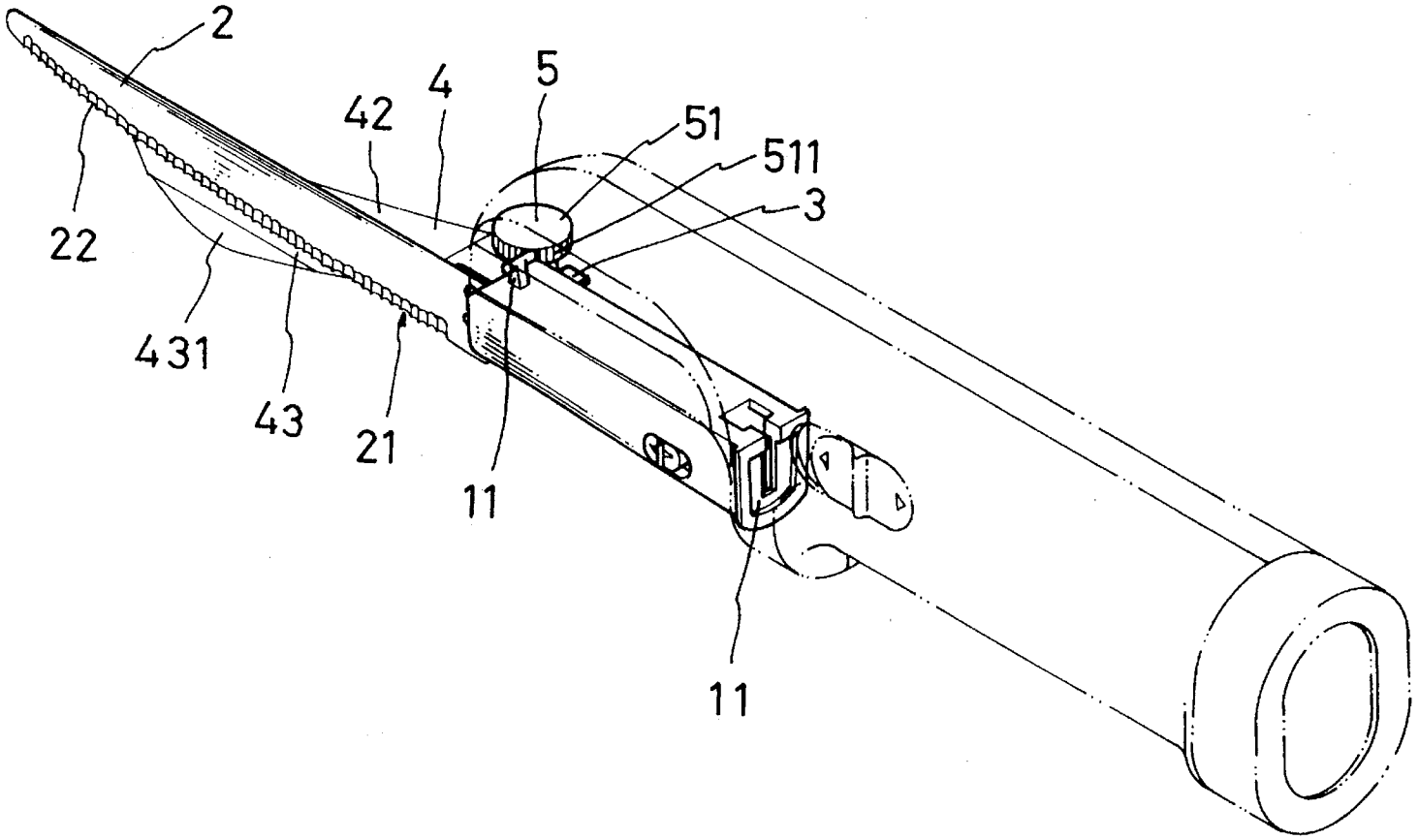
FIG. 3 is a perspective view illustrating the cutting tool of the present invention adapted for use with a motor housing base.

Furthermore, in order that the cutting tool of the present invention may be connected to a motor housing base of a cutting tool intended for use to strip the skin from a vegetable or fruit (U.S. Pat. No. 5,230,155 to the Applicant), the handle 1 may further be provided with the insert means 11, as shown in FIG. 3. Moreover, in order that the cutting tool of the present invention may be adapted for use by both left-handers and right-handers, the support piece 3 and the press piece 4 may be respectively arranged at the left or right side of the blade 2. As such is known in the art, it will not be further described herein.

In summary, the cutting tool according to the present invention may be used to cut slices of uniform thickness and may be easily adjusted to cut slices of a predetermined thickness.

Although the present invention has been illustrated and described with reference to the preferred embodiment thereof, it should be understood that it is in no way limited to the details of such embodiment but is capable of numerous modifications within the scope of the appended claims.

What is claimed is:

1. A cutting tool capable of cutting slices of a predetermined thickness, comprising:

an elongate handle;

a sheet-like blade connected to said handle, said blade having a lower edge sharpened to form a cutting edge;

a substantially L-shaped support piece connected onto said blade adjacent to said handle, said support piece having a part thereof perpendicular to said blade, the part being provided with a hole having multiple inner threads;

a press piece consisting of a press seat, a horizontal upper portion and a vertical portion perpendicular to said upper portion, said press seat being dimensioned to match the part of said support piece with said hole and having an elongate slot, said vertical portion having a width greater than the width of said blade; and a rotary knob having a cap and a shaft projecting from a bottom of the cap, said shaft being dimensioned to match said hole of said support piece and having multiple threads matching said inner threads of said hole of said support piece, the shaft being passable through the slot of the press seat and threadedly engageable in said hole of said support piece.

2. A cutting tool as claimed in claim 1, wherein said handle is provided with an insert means for coupling with a motor housing base.

3. A cutting tool as claimed in claim 1, wherein said cutting edge is of a corrugated configuration.

4. A cutting tool as claimed in claim 1, wherein said cap includes a plurality of circumferential spaced ribs.

5. A cutting tool as claimed in claim 1, wherein said press piece is integrally formed.

6. A cutting tool as claimed in claim 1, wherein said support piece, said press piece and said rotary knob are disposed at one of two opposite sides of said blade.

7. A cutting tool as claimed in claim 1, wherein said press seat of said press piece includes both ends configured to form curves for wrapping said support piece.

8. A cutting tool as claimed in claim 1, wherein an end of said upper portion of said press piece adjacent to said press seat includes at least one curved portion.

* * * * *